US008091165B2

(12) United States Patent
Mossbeck

(10) Patent No.: US 8,091,165 B2
(45) Date of Patent: Jan. 10, 2012

(54) MODULAR BEDDING SYSTEM INCLUDING MODULAR BED BASE

(75) Inventor: Niels S. Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 1472 days.

(21) Appl. No.: 11/329,998

(22) Filed: Jan. 11, 2006

(65) Prior Publication Data

US 2007/0157387 A1 Jul. 12, 2007

(51) Int. Cl.
*A47B 7/00* (2006.01)
*A47C 19/00* (2006.01)

(52) U.S. Cl. ..... 5/620; 5/400; 5/617; 5/618; 5/200.1; 5/201

(58) Field of Classification Search ..... 5/620, 616–618, 5/186.1, 200.1, 201, 238, 400
See application file for complete search history.

(56) References Cited

U.S. PATENT DOCUMENTS 2,211,453 A * 8/1940 Buttikofer ..... 5/634
2,666,216 A * 1/1954 Schnaitter ..... 5/660
3,046,071 A * 7/1962 Shampaine et al. ..... 5/608
3,636,573 A 1/1972 Bartz
3,768,106 A * 10/1973 Fitzgerald et al. ..... 5/131
3,921,230 A * 11/1975 Hanning et al. ..... 5/616
4,103,170 A * 7/1978 Spradlin ..... 378/179
4,109,328 A * 8/1978 Mason ..... 5/2.1
4,116,509 A * 9/1978 Smith ..... 312/107
4,155,131 A * 5/1979 Harris et al. ..... 5/296
4,218,789 A * 8/1980 Grassi ..... 5/201
4,718,132 A * 1/1988 Wirland ..... 5/11
4,734,946 A * 4/1988 Saputo ..... 5/400
5,070,556 A * 12/1991 Gloger ..... 5/308
5,144,706 A * 9/1992 Walker ..... 5/400
5,224,228 A * 7/1993 Larrimore ..... 5/613
5,231,715 A * 8/1993 Strobel ..... 5/400
5,267,362 A * 12/1993 Johenning et al. ..... 5/400
5,425,150 A * 6/1995 Palmer et al. ..... 5/615
5,469,589 A * 11/1995 Steed et al. ..... 5/400
5,544,375 A * 8/1996 Urness et al. ..... 5/611
5,544,376 A 8/1996 Fromson
5,564,140 A * 10/1996 Shoenhair et al. ..... 5/400
5,579,550 A * 12/1996 Bathrick et al. ..... 5/620
5,740,568 A * 4/1998 Elliott ..... 5/620
5,829,075 A * 11/1998 Stewart, Jr. ..... 5/202
5,829,077 A * 11/1998 Neige ..... 5/618
5,870,784 A 2/1999 Elliott
5,969,488 A 10/1999 Fromson
5,996,145 A * 12/1999 Taylor ..... 5/200.1
6,079,065 A * 6/2000 Luff et al. ..... 5/618
6,209,157 B1 * 4/2001 Hensley ..... 5/618
6,216,295 B1 * 4/2001 Pearson ..... 5/618
6,219,863 B1 * 4/2001 Loberg et al. ..... 5/236.1
6,276,011 B1 * 8/2001 Antinori ..... 5/618
6,357,065 B1 * 3/2002 Adams ..... 5/618
6,510,571 B1 * 1/2003 Tittle et al. ..... 5/400

(Continued)

*Primary Examiner* — Jonathan Liu
(74) *Attorney, Agent, or Firm* — Wood, Herron & Evans, LLP

(57) ABSTRACT

A module bedding system comprises a universal base having removable mattress supporting panels, a headrest adjustable module and a footrest adjustable module. The universal base may be used with the removable panels in place to support a conventional non-adjustable mattress or the removable panels may be removed and the adjustable modules substituted to enable the base to support either a headrest adjustable mattress or a headrest and footrest adjustable mattress.

20 Claims, 5 Drawing Sheets

U.S. PATENT DOCUMENTS

| | | | | |
|---|---|---|---|---|
| 6,708,358 | B2 * | 3/2004 | Hensley | 5/915 |
| 6,857,148 | B2 * | 2/2005 | Van Raemdonck | 5/617 |
| 6,907,631 | B2 | 6/2005 | Heaton | |
| 6,951,037 | B2 | 10/2005 | Weinman et al. | |
| 6,978,498 | B2 * | 12/2005 | Gavela Vazquez | 5/400 |
| 6,990,698 | B2 * | 1/2006 | Wall, Sr. | 5/618 |
| 2001/0044961 | A1 * | 11/2001 | Epstein et al. | 5/201 |
| 2004/0187213 | A1 | 9/2004 | Wang | |
| 2004/0194213 | A1 * | 10/2004 | Weinman et al. | 5/618 |
| 2005/0005357 | A1 * | 1/2005 | Van Raemdonck | 5/617 |
| 2005/0210588 | A1 * | 9/2005 | Loewenthal | 5/618 |
| 2005/0251917 | A1 * | 11/2005 | Wall | 5/618 |
| 2005/0273932 | A1 * | 12/2005 | Horlin | 5/611 |

* cited by examiner

MODULAR BEDDING SYSTEM INCLUDING MODULAR BED BASE

FIELD OF THE INVENTION

This invention relates generally to bedding products and more particularly, to a modular bedding system, including a modular bed base or foundation for supporting non-adjustable, as well as adjustable, mattresses.

BACKGROUND OF THE INVENTION

At the present time, there exists in the marketplace bed bases or foundations for non-adjustable mattresses and bed bases or foundations for supporting adjustable mattresses. Presently, though, those bed bases have nothing in common, either structurally or in terms of cost. The bed bases for adjustable mattresses are much more complex in structure and much more expensive than bed bases used to support non-adjustable mattresses.

Commonly, the bed bases for adjustable mattresses are manufactured and sold fully assembled or, sometimes in pieces, but irrespective of whether fully assembled or in pieces, if applied to a queen size bed, those pieces are heavy and large, oftentimes so large that they are very difficult to transport to and through doorways, stairs, etc., of small apartments or homes.

In most cases, adjustable beds are now sold with a large fixed base which supports an adjustable head section and an adjustable footrest section. As such, these adjustable beds are sold at a price substantially higher than non-adjustable beds for supporting flat, non-adjustable mattresses. The price difference between the two, non-adjustable or adjustable beds, is now very substantial. It would be desirable to minimize this price difference. To date, however, that has not been possible because of the differing complexity of the two products.

It is therefore one objective of this invention to provide a modular bedding base or foundation which may be used to either support a fixed non-adjustable mattress or with minimum modification and addition to support an adjustable mattress.

Still another objective of this invention is to provide a modular bedding system which includes a modular bed base, a modular adjustable headrest supporting module, another modular adjustable footrest supporting module, so constructed that the headrest supporting module may be utilized with the modular base, either with or without the modular footrest adjustable module and similarly, the adjustable footrest adjustable module may be used with or without the adjustable headrest supporting module.

Still another objective of this invention is to provide a modular bedding system particularly designed for the after market, such that it may be sold as a fixed non-adjustable bed with a non-adjustable mattress, but may be, at minimum expense, upgraded to a bed base for supporting a headrest adjustable mattress and/or a headrest and footrest adjustable mattress.

SUMMARY OF THE INVENTION

To achieve these objectives, the invention of this application comprises a modular bedding system having a bed base which includes removable head and foot deck panels. The bed base is so constructed that the removable head deck panel may be removed and replaced by an articulating head section module, such that the bed, including the original base may then function as a headrest adjustable bed. The foot removable deck panel may also be removed and replaced by an articulating adjustable foot section module, such that the foot section of the bed, still including the original base, may now be adjustable. The adjustment of the headrest and footrest adjustable modules may be as simple as a ratchet mechanism for raising or tilting the head section or the foot section of the bed, or the modules may be independently motorized and controlled by a conventional hardwired hand wand or by a wireless remote.

A primary advantage of this modular bedding system is that it enables a bedding retailer to sell this modular bed base to a customer with a non-adjustable fixed mattress and then later upgrade that modular bed by selling relatively inexpensive headrest or footrest adjusting modules at prices which are substantially lower than the current differential in price between non-adjustable beds and adjustable beds. It also enables a bedding retailer who sells both adjustable and non-adjustable beds to substantially lower the inventory of products needed to serve both markets.

Yet another advantage of this invention is that it enables customers to pick and choose the features which they desire on a bed, i.e., adjustability or non-adjustability, manual adjustment of the headrest or footrest, or motorized adjustment of the headrest or footrest, attached vibrator for vibrating the headrest or footrest panels, etc., in much the same manner as customers are now accustomed to ordering computers with customized features. It also facilitates ordering a customized bed either from a retail bedding establishment or from a website.

Still another advantage of this invention resides in the fact that because the whole bedding system is modular, it may be easily transported from a sale site to the customer and moved into and through stairways and doorways with minimal space clearance requirements.

These and other advantages of this invention will become more readily apparent from the following description of the drawings, in which:

DETAILED DESCRIPTION OF THE DRAWINGS

Figure 1:
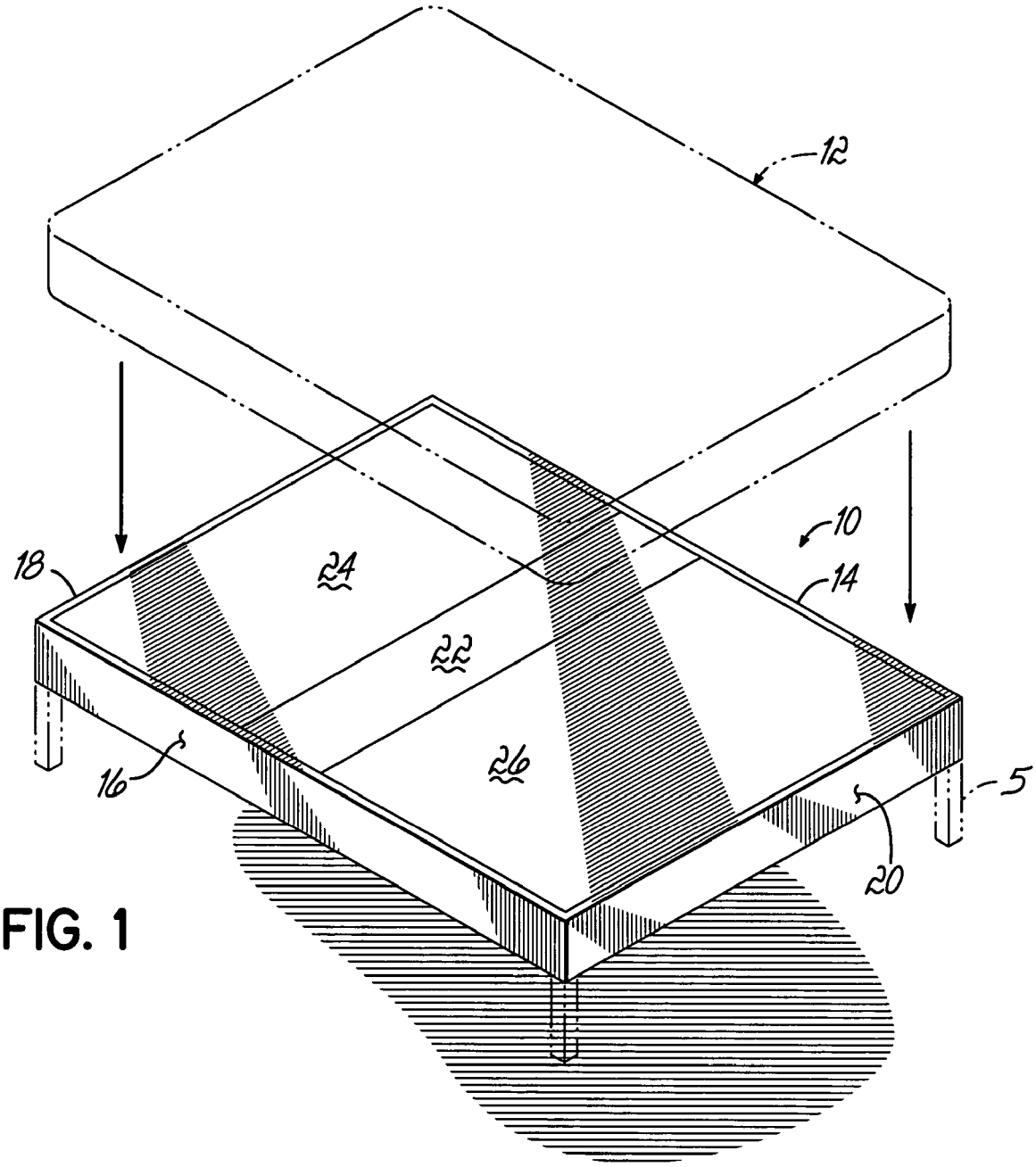
FIG. 1 is a perspective view of a bed base or foundation used in the practice of this invention and illustrating in phantom a mattress placed upon the top of the base.
Figure 2:
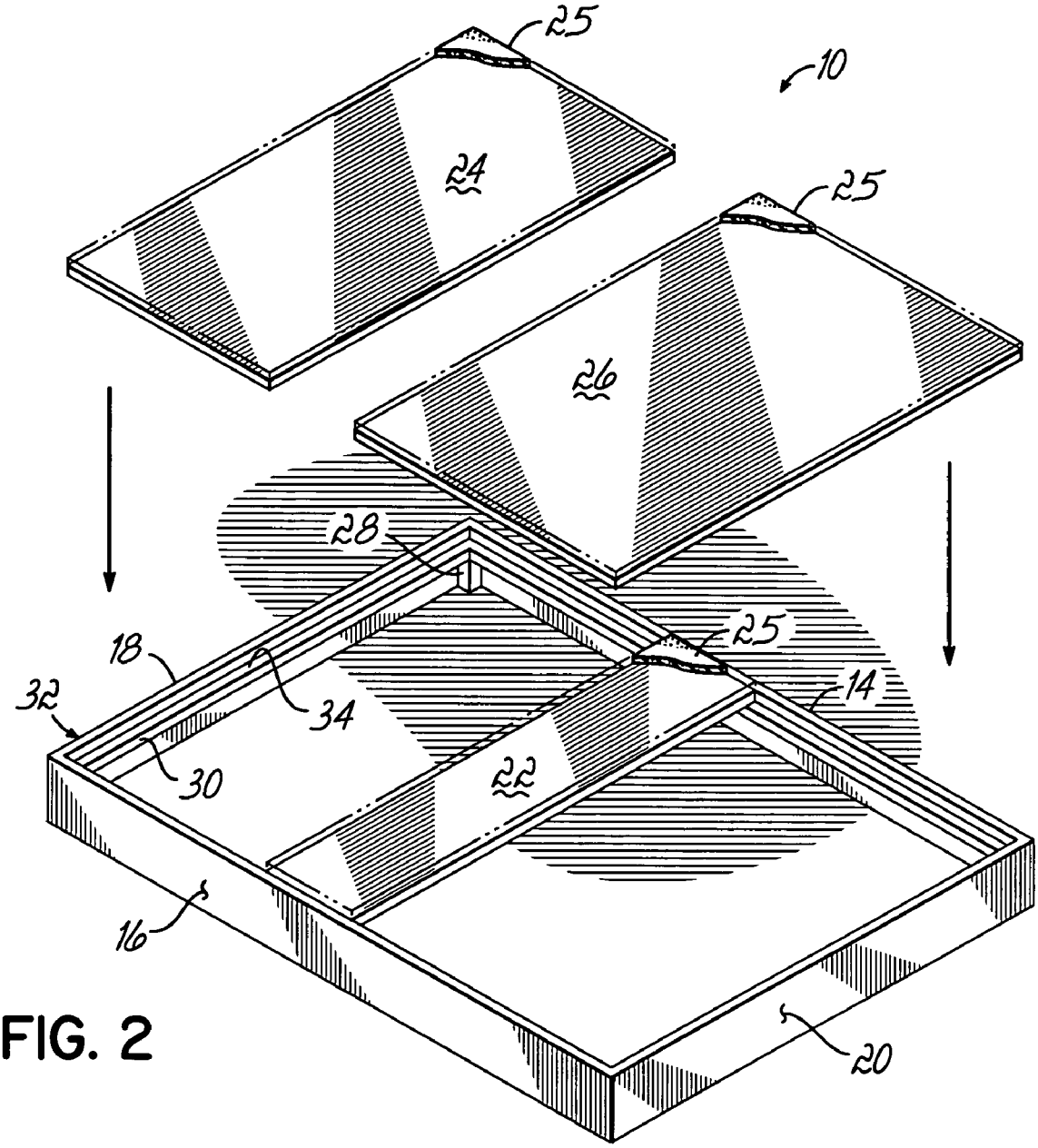
FIG. 2 is an exploded perspective view of the bed base of FIG. 1.

With reference first to FIGS. 1 and 2, there is illustrated a wooden bed base or foundation 10 for supporting a mattress 12. The wooden bed base 10 comprises two side boards 14, 16, a head end board 18, and a foot end board 20. These side boards and end boards form a rectangular perimeter frame operative to support a center deck board 22, as well as a removable head deck board or panel 24 and a removable foot deck board or panel 26. The center deck board, or panel 22, extends between the two side boards 14, 16 and is preferably fixed to them as opposed to being removable as are the head deck board 24 and removable foot deck board 26. The side boards 14 and 16, as well as the head end board and foot end boards 18 and 20 are assembled and maintained in a rectangular assembly by conventional corner blocks or corner brackets 28 (one of four shown).

As shown in FIG. 1, the bed base 10 of the present invention may be supported by legs 5 (shown in phantom) or may be supported inside a metal bed frame (not shown) as is conventional.

As shown in FIG. 2, the removable head and foot deck boards 24, 26, as well as center deck board 22, may be covered with padding 25 such as foam or any other suitable material. Any other panels such as those described below may likewise be covered with such padding.

In one preferred embodiment of this invention, the perimeter frame comprising these side boards and end boards are made of 7½" high by ¾" thick solid wood panels, or wood composite materials, such as plywood or particle board, or MDF (medium density fiberboard). A wooden or metal support 30 having a lip 34 extends around the inside periphery of the rectangular frame 32 approximately 1 inch beneath the top edge of the side boards 14, 16 and end boards 18 and 20. The lip 34 of this support 30 forms a lip upon which the center deck board or panel 22 rests and is secured and upon which the head deck board 24 and foot deck board 26 rest. Generally, the center deck board, or panel 22, will be braced on the underside to avoid sagging when the load of a mattress and persons lying on the mattress 12 is applied to the bed.

The components heretofore described, other than the mattress, are all preferably made of metal, wood or wood composite materials, but they need not always be made of these materials, as other materials, such as plastic, will often suffice. As used in the specification and claims of this application, the term "wood" or "wooden" is intended to include not only solid wood materials or wood panels, but also wood composite materials, such as plywood or particle board or MDF.

Figure 3:
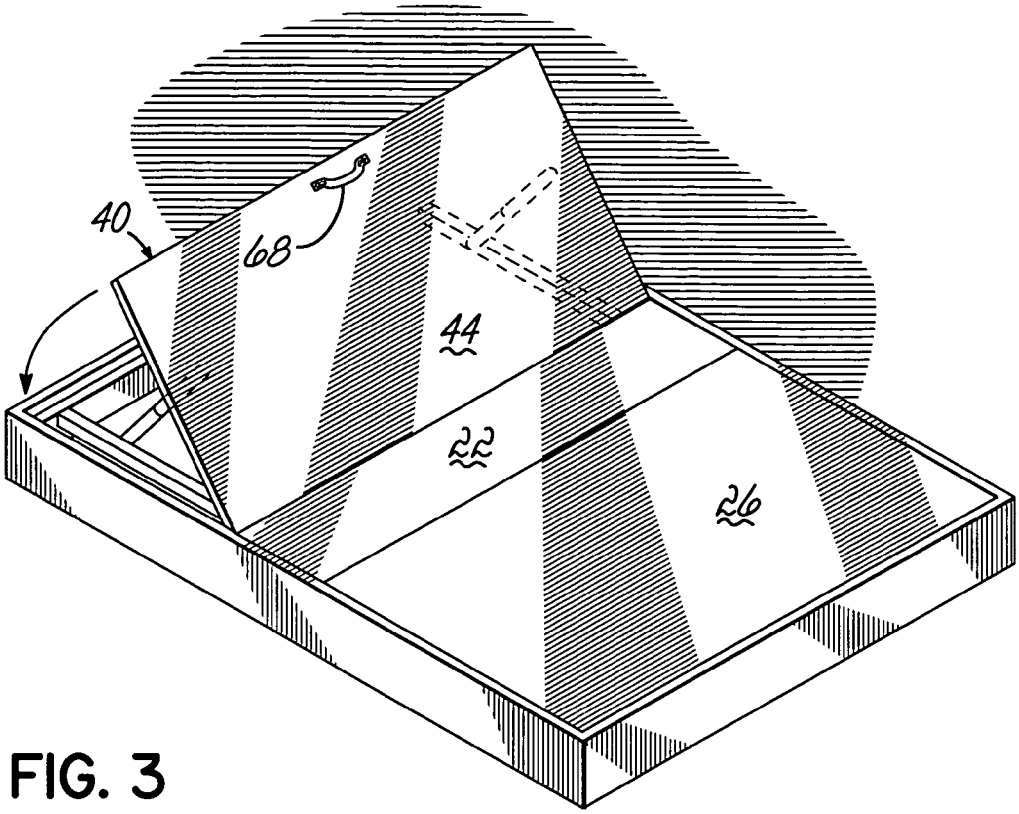
FIG. 3 is a perspective view of the bed base of FIG. 1, but with a head deck panel replaced by an adjustable head section module.
Figure 5:
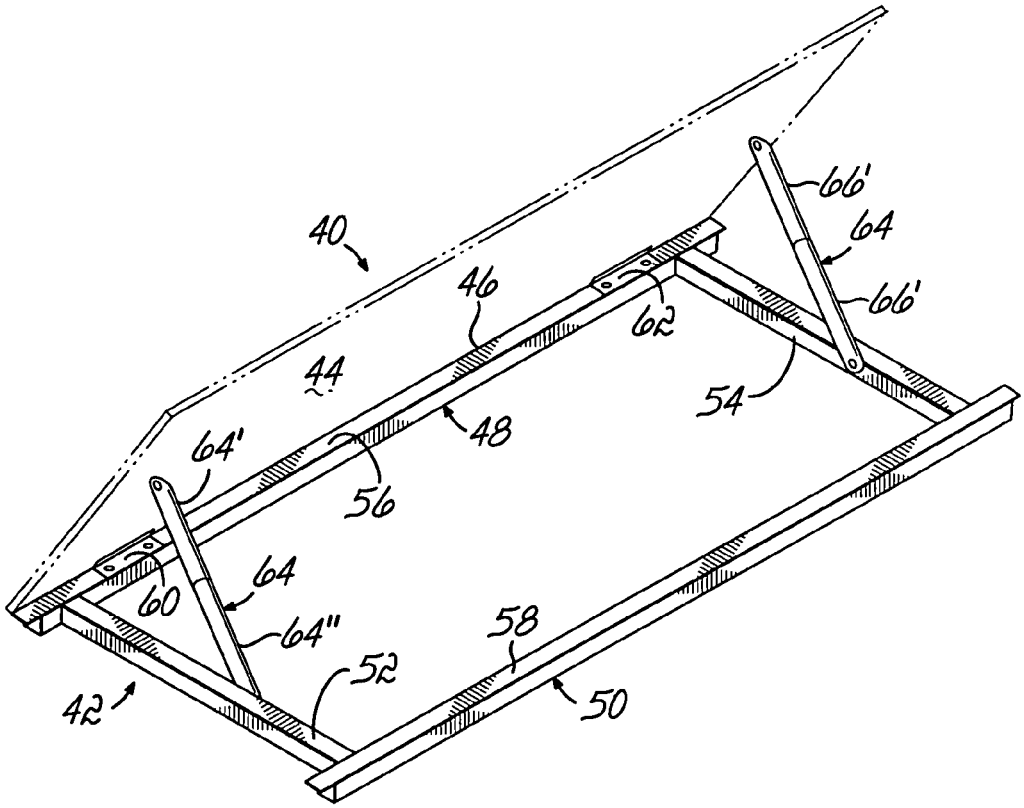
FIG. 5 is a perspective view of an adjustable head section module having the head deck panel supported by a conventional adjustable ratchet mechanism, the head deck panel of the module being illustrated in phantom.

With reference now to FIGS. 3 and 5, there is illustrated an articulating adjustable head section module 40 which may be substituted in this modular bedding system for the head deck board or panel 24 in order to convert the bed base 10 from one for supporting a non-adjustable mattress 12 to one for supporting a headrest adjustable mattress. With particular reference to FIG. 5, it will be seen that the adjustable head section module 40 comprises a rectangular frame 42 pivotally connected at its forward end to a head deck board or panel 44 along one edge 46 of the head deck board or panel 44. The head deck board or panel 44 may, in fact, be the same removed head deck board 24, as was removed from the base 10 in order to enable the adjustable head section module 40 to be substituted for the head deck panel 24.

The frame 42 is preferably a metal frame made from angle iron. It comprises a front bar 48, a rear bar 50, and a pair of side bars 52, 54, all welded together, or otherwise fixedly secured together so as to create a rectangular frame. The front and rear bars 48 and 50 have a top horizontal flange 56, 58, respectively, which rests upon the top surface 30 of the lips 34 so as to support the module 40 in the base 10 after removal of the head deck board 24 from that panel.

In order to accommodate articulated or pivotal movement of the head deck board or panel 44 relative to the frame 42, the head deck panel 44 is pivotally connected by conventional hinges 60, 62 secured to the top flange 56 of the front bar 48 and the forward underside surface of the head deck panel 44 near the head end of that board. These hinges 60, 62 may be conventional piano hinges or any other conventional type of hinge which permits articulated pivotal movement between the head deck panel 44 and the front bar 48.

Extending between the underside surface of the head deck board or panel and the side bars 52, 54, there are a pair of conventional ratchet mechanisms 64, 66. Each of these ratchet mechanisms 64, 66 comprises two pivotally interconnected bars 64', 64", 66', 66", which are pivotally connected to the underside of the head deck board or panel 44 and to the side bars 52, 54, respectively. These pivotally interconnected bars 64', 64" and 66', 66" function as a ratchet mechanism to enable the head board or panel 44 to be manually lifted upwardly from a position resting atop the side bars 52, 54 to an angled position and then maintained in that position by the ratchet part of the mechanism 64, 66. Two such conventional articulating ratchet mechanisms suitable for this application are manufactured by Hettich/Franke Company and identified as that company's "Multiflex F" mechanism and "Rasto S" mechanism.

In order to convert the bed frame 10 from one for supporting a flat, non-adjustable mattress to one for supporting an adjustable mattress, all that is required is to remove the head deck board 24 from its position resting atop the supports 30 and replacing that head deck board or panel 24 with the head section adjustable module 42 shown in FIG. 5. Thereafter, whenever the mattress is to be adjusted so as to lift the head end of the mattress upwardly and place a person supported on the mattress in a position in which their head is up for purposes of reading or watching television, etc., all that is required is for the person to grip a lifting device, such as a handle or strap 68 (see FIG. 3) secured to the top surface of the head deck panel 44 and lift that panel to the desired angled position. To return the mattress to a flat or horizontal condition, all that is then required is to lift the handle and deck slightly and then drop the head deck panel 44 back into a horizontal position resting atop the top surface of the side bars 52, 54.

Figure 6:
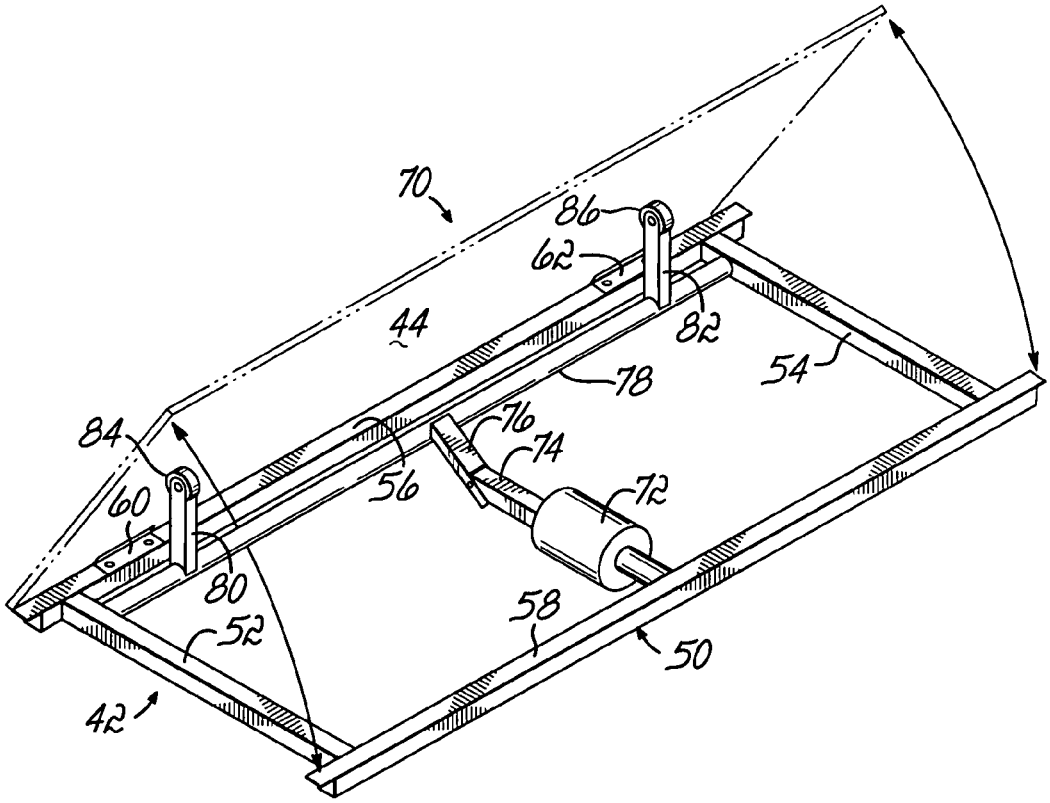
FIG. 6 is a view similar to FIG. 5, but illustrating a motorized version of the head section module.

With reference now to FIG. 6, there is illustrated a motorized version of the articulating adjustable head section module. This FIG. 6 modification is substantially identical to the manually operated articulating adjustable head section module 40 of FIG. 5, the difference being that the motorized module 70 utilizes a motor to lift and drop the head deck panel 44 onto and off of the frame 42, as opposed to the manual version of FIG. 5, which requires that the head deck panel 44 be lifted and dropped manually from and to the side bars 52, 54. For purposes of describing this motorized modification, those portions of the articulating adjustable head section module 70 of FIG. 6, which are identical to the module 40 of FIG. 5 have been given identical numerical designations.

The adjustable head section module 70 utilizes an electric motor 72 attached to the rear frame bar 50. This motor 72 activates a worm gear (not shown) contained internally of the motor housing which in turn controls a push-pull rod 74. The push-pull rod 74 is hingedly or pivotally connected to a lever arm 76 which is, in turn, fixedly secured to a torque rod or torque tube 78. This torque tube 78 is rotatably mounted and extends between the side bars 52, 54. There are two arms 80, 82 fixed to the torque tube 78 extending beneath the underside of the head deck panel or board 44. Rollers 84, 86 are rotatably mounted on the ends of these arms 80, 82 and engage the underside of the head deck board 44. Upon activation of the electric motor 72, the push-pull rod 74 moves inwardly so as to cause the arms to move upwardly and push the head deck panel 44 upwardly. To return the head deck panel 44 to its horizontal position, the motor 72 is activated so as to push the push-pull rod 74 outwardly from the motor 72 and thereby lower the arms 80, 82 and the head deck panel 44. As is conventional in motorized adjustable beds, the motor 72 is operated and controlled either from a wired hand wand or control unit (not shown), or a wireless hand control unit or remote (also not shown). Since those controls are conventional in motorized adjustable beds, they have not been illustrated in this application.

As with the manual articulated adjustable head section module 40 of FIG. 5, the motorized articulated adjustable head section module 70 may be utilized in connection with the bed base 10 by simply again removing the head deck board or panel 24 and replacing it with the motorized module 70. The frame 42 of the module 70 then rests atop the supports 30 of the base 10 and is then operable to control adjusting movement of the head end of the mattress 12 supported atop the bed base 10.

Figure 4:
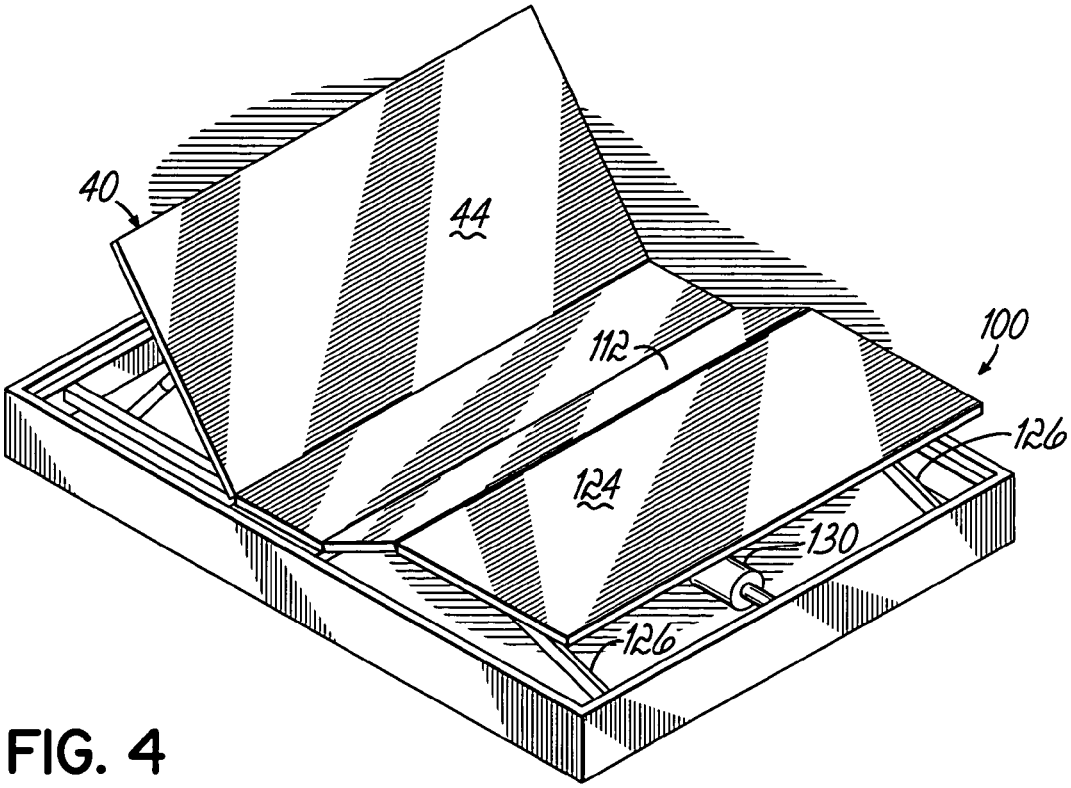
FIG. 4 is a view similar to FIG. 3, but illustrating the foot deck panel replaced by an adjustable foot section module.
Figure 7:
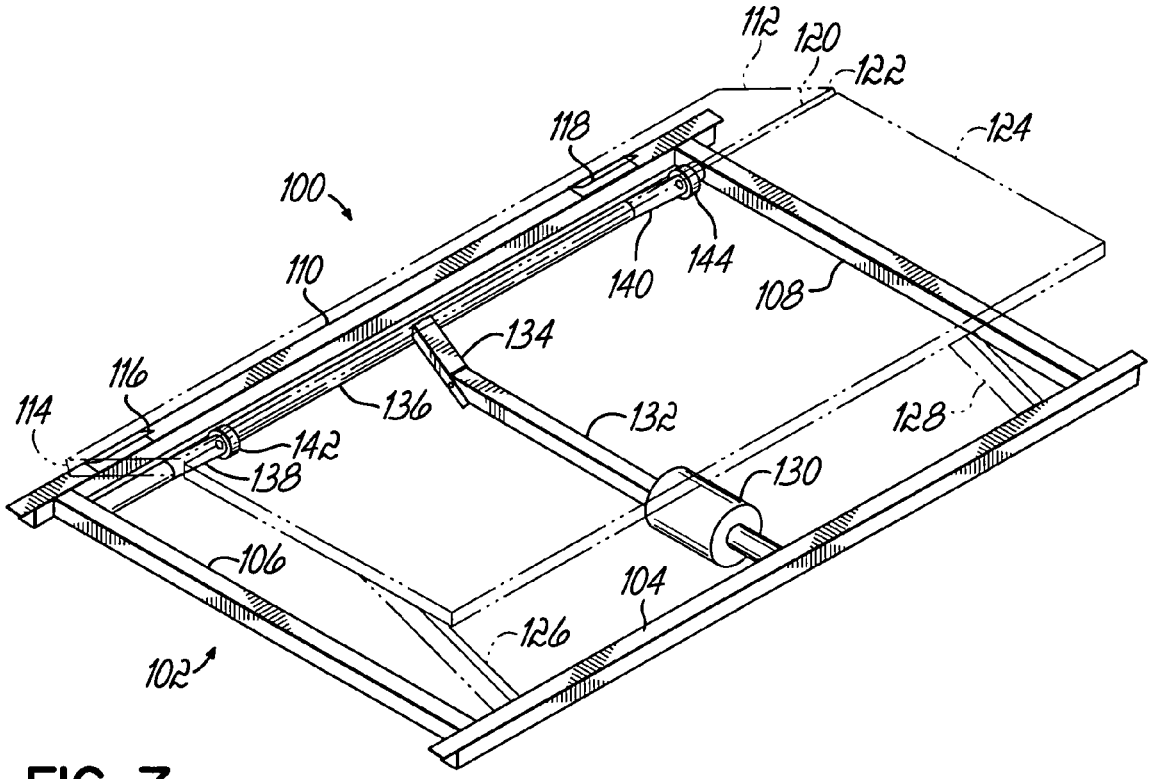
FIG. 7 is a perspective view of an adjustable motorized foot section module illustrating the leg and foot supporting boards of the module in phantom.

With reference now to FIGS. 4 and 7, there is illustrated a motorized articulating adjustable foot section module 100 which may be substituted for the foot deck board or panel 26 so as to convert the bed from one having a non-adjustable foot section to one having an adjustable foot section. The adjustable foot section module 100 includes a rectangular frame 102 having a rear end bar 104, a pair of side bars 106, 108, and a forwardmost or center bar 110. These bars 104, 106, 108, 110 are preferably metal and made from angle iron, which is welded or otherwise secured together to create the rectangular frame 102 so sized as to have the same overall dimensions as the removable foot deck board 26. So sized, the module 100 may be physically inserted into the frame 14 and rest atop the supports 30 of the frame upon removal of the removable deck panel 26.

In this module 100, a leg support board 112 is hingedly supported and connected at its forwardmost edge 114 to the center bar 110 by hinges 116, 118. Again, these hinges may be piano-type-style hinges or any conventional hinge which enables the leg support board or panel 112 to pivot and move relative to the center bar 110.

The rearward edge 120 of the leg support board 112 is hingedly connected by hinges (not shown) to the forward edge 122 of a foot support board or panel 124. A pair of pivoted links 126, 128 connect the underside of the foot support board 124 to the rear bar 104 of the frame 102. The links 126 are pivotally connected at their opposite or forward ends to the underside of the deck 124. These links 126, 128 function to control the elevation of the foot board or deck 124 when the foot support board 124 is moved upwardly and downwardly by a motor 130.

As shown in FIG. 7, the motor 130 and its control linkage functions very similarly to the motor 72 shown in FIG. 6 to control movement of the leg support border panel 112. At its rearward end, the motor 130 is connected to the rear bar 104 of the frame. As was the case with the motor 72, when the motor 130 is actuated, it activates a worm gear drive internally of the motor housing to move a push-pull rod 132 toward or away from the motor 130. The push-pull rod 132 is, in turn, hingedly or pivotally connected to a lever arm 134 which is in turn fixedly connected at its forwardmost end to a torque tube 136. The torque tube 136 extends between and is rotatable supported by the side bars 106, 108 of the frame 102. Also fixedly attached to the torque tube 136 are a pair of arms 138, 140, the outer ends of which support rollers 142, 144, respectively. These rollers 142, 144 engage the underside of the leg supporting board or panel 112, such that upon the push-pull rod 132 moving rearwardly, the rollers 142, 144 move over the underside of the leg support board or panel 112 and cause that board or panel 112 to be lifted upwardly. Alternatively, when the push-pull rod 132 is pushed away from the motor 130 and the rear of the frame 102, it causes the rollers 142, 144 and the arms 138, 140 upon which they are mounted to move downwardly, thereby lowering the leg support board or panel 112.

Control of the motor 130 is via a conventional wired hand wand or control unit, or a wireless remote or control unit, as is conventional with motorized adjustable beds.

In order to convert the bed base 10 from one which supports a non-adjustable flat mattress to one which supports a mattress having a foot and leg rest which may be elevated, all that is required is to remove the removable deck panel 26 from the frame 10 and replace it with the adjustable foot section module 100. Assuming that the mattress 12 is an adjustable mattress, the bed will thereby be converted from one having a non-adjustable foot section to one having an adjustable leg and foot section.

When the motorized foot section module 100 is used to replace the removable deck panel or board 26, the electric motor 130 of the module 100 is plugged into a control box (not shown) which also controls the motor of the head section module 70 and the same common hand wand (wired or wireless) is used to control operation of the foot section module 130, as well as the motor 72 of the adjustable head section module.

Another option which could be utilized with the modular bed system described hereinabove would be to add a massage unit, including an electric motor with an eccentric load on the motor attached to the underside of the articulating or adjustable deck boards 44, 124. Such a massage unit would presumably be controlled by the same remote as is used to control the motors 72, 130 of the articulating head and foot section modules. One such massage unit is described in applicant's U.S. patent application Ser. No. 11/108,995 which is fully incorporated herein.

While I have described preferred embodiments of this invention, persons skilled in this art will appreciate changes and modifications which may be made without departing from the spirit of my invention. Therefore, I do not intend to be limited except by the scope of the following claims.

I claim:

1. A modular bedding system, comprising:

a rectangular bed base having a fixed deck panel and a removable head end deck panel;

a lip extending around the inside periphery of the bed base;

an articulating adjustable head section module supported by said lip; and said adjustable head section module being interchangeable with said head end deck panel without removing said lip to enable said modular bedding system to support a non-adjustable flat mattress or to a support a head end articulated adjustable mattress wherein said articulating adjustable head section module comprises a rectangular frame, an articulating head deck board pivotally secured onto one side of said rectangular frame and an adjusting mechanism for enabling said head deck board to be pivotally moved upwardly about said one side of said rectangular frame.

2. The modular bedding system of claim 1 which further comprises:

a removable foot end deck panel; and an articulating adjustable foot section module, said adjustable foot section module being interchangeable with said foot end deck panel when said modular bedding system is used to support an articulating adjustable mattress.

3. The modular bedding system of claim 1 wherein said articulating adjustable head section module is motorized.

4. The modular bedding system of claim 3 which further comprises:

a removable foot end deck panel; and an articulating adjustable foot section module, said adjustable foot section module being interchangeable with said foot end deck panel when said modular bedding system is used to support an articulating adjustable mattress.

5. The modular bedding system of claim 1 wherein said adjusting mechanism comprises at least one racket mechanism extending between said rectangular frame and said head deck board.

6. The modular bedding system of claim 1 wherein said adjusting mechanism comprises a motor for pivotally moving said head deck board upwardly about said one side.

7. The modular bedding system of claim 1 wherein said adjusting mechanism comprises a motor for pivotally moving said head deck board upwardly about said one side;

said rectangular frame including a rotatable torque tube, said motor being mounted on said rectangular frame and being operable to rotate said torque tube;

at least one link fixedly attached at one end to said torque tube and a roller attached to the opposite end of said link, said roller being engageable with a bottom side of said deck board.

8. The modular bedding system of claim 1 wherein said rectangular bed base comprises:

two opposite facing side boards, a head end board, and a foot end board, said side boards and end boards being interconnected so as to form a rectangular frame;

each of said side and end boards having an inside surface, an outside surface and top and bottom edges;

said lip extending inwardly from the side and end boards of the bed base, said lip having a top surface located beneath the top edge of said side and end boards;

a center deck board extending between said side boards and secured to said lip of said side boards; and said head end panel being adapted to be received atop said lip when said bedding system is used to support a non-adjustable flat mattress.

9. The modular bedding system of claim 8 wherein said adjustable head section module is adapted to be received atop said supports when said bedding system is used to support an articulated adjustable mattress.

10. The modular bedding system of claim 1 wherein said removable head end deck panel is covered with padding.

11. The modular bedding system of claim 1 wherein said adjustable head section module utilizes a motor to lift and drop the articulating head deck board onto and off of the rectangular frame.

12. A modular bedding system, comprising:

a rectangular bed base having two side boards, a head end board and a foot end board;

a lip extending around the inside periphery of the bed base;

a fixed center deck panel resting on the lip;

a removable head end deck panel supported atop said lip of said base;

a removable foot end deck panel supported atop said lip of said base;

a removable articulating adjustable head section module having a frame which rests on the lip of the base when the removable head end deck panel is removed and the removable articulating head section module inserted into the bed base; and said adjustable head section module being interchangeable with said head end deck panel, said bed base functioning as a support for a non-adjustable flat mattress when said head end deck panel is located on said bed base and as a support for an articulated adjustable mattress when said articulating adjustable head section module is located on said bed base.

13. The modular bedding system of claim 12 which further includes:

an articulating adjustable foot section module, said adjustable foot section module being interchangeable with said foot end deck panel, said modular bed base functioning as a support for a leg and footrest articulated mattress when said adjustable foot section module is located on said bed base.

14. A modular bedding system comprising:

a universal base having a lip extending around the inside periphery of the bed base, said lip supporting removable mattress supporting panels;

a headrest adjustable module;

a footrest adjustable module;

said universal base being operable to support a non-adjustable mattress with said removable panels in place on said lip of said base and being operable to support an adjustable mattress with at least one of said adjustable modules located atop said lip of said universal base.

15. The modular bedding system of claim 14 wherein said universal base is operable to support said footrest adjustable module upon replacement of another removable panel by said footrest adjustable module.

16. A modular bedding system, comprising:

a wooden mattress supporting frame having two opposite facing side boards and two opposite facing end boards, each of said side and end boards having an inside surface, an outside surface and top and bottom edges, said end boards being secured to said side boards at opposite ends of said side boards;

a lip extending around the inside periphery of the bed base, said lip being secured to the inside surface of said two side boards and said two end boards, said lip having a top surface located beneath the top edge of said side and end boards;

a center deck board fixedly extending between said side boards and secured to said lip; and a pair of removable deck boards located on opposite sides of said center deck board and resting atop said lip; and a motorized adjustable section module being interchangeable with one of said removable deck boards without removing the lip.

17. A bedding system comprising:

a mattress supporting frame having two opposite facing side panels, a head end panel, and a foot end panel, said side panels and end panels being interconnected so as to form a rectangular frame;

each of said side and end panels having an inside surface, an outside surface and top and bottom edges;

a lip secured to the inside surface of said two side and end panels, said lip having a top surface located beneath the top edge of said side and end panels;

a center deck panel fixedly extending between said side boards and resting on the lip; and a pair of removable deck panels located on opposite sides of said center deck panel and resting atop said lip; and a motorized adjustable section module being interchangeable with one of said removable deck panels without removing the lip, said motorized adjustable section module comprising a rectangular frame adapted to rest upon the top surface of the lip to support the motorized adjustable section module in the base.

18. The bedding system of claim 17 wherein side panels and end panels are all wooden panels.

19. A modular bedding system, comprising:

a rectangular bed base having a pair of side boards, a head end board and a foot end board, said side boards being longer than said head end and foot end boards, each of said boards having a lip secured to an inside surface of the board;

a fixed deck panel extending between said side boards of said rectangular bed base resting on the lip of the bed base and a removable head end deck panel resting on the lip of the bed base;

an articulating adjustable head section module having a metal frame having the same dimensions as the removable head end deck panel; and said adjustable head section module being interchangeable with said head end deck panel and adapted to rest on said lip to enable said modular bedding system to support a non-adjustable flat mattress or to a support a head end articulated adjustable mattress.

20. A modular bedding system, comprising:

a rectangular bed base having a lip and a fixed deck panel and a removable deck panel resting on said lip;

a motorized adjustable section module having a metal frame having the same dimensions as the removable deck panel, said metal frame being adapted to rest on said lip; said motorized adjustable section module being interchangeable with said removable deck panel to enable said modular bedding system to support a non-adjustable flat mattress or to support an articulated adjustable mattress wherein said modular bedding system further comprises a second removable deck panel and a second motorized adjustable section module interchangeable with the second removable deck panel and having a metal frame having the same dimensions as the second removable deck panel and wherein said removable deck panels are covered with padding.

* * * * *

UNITED STATES PATENT AND TRADEMARK OFFICE

CERTIFICATE OF CORRECTION

PATENT NO. : 8,091,165 B2
APPLICATION NO. : 11/329998
DATED : January 10, 2012
INVENTOR(S) : Niels S. Mossbeck It is certified that error appears in the above-identified patent and that said Letters Patent is hereby corrected as shown below:

Column 3

Line 21, "end boards are" should be --end boards is--.

Column 4

Line 8, "there are a pair" should be --there is a pair--.

Column 5

Line 44, "connect the underside" should be --connects the underside--.

Line 61, "rotatable" should be --rotatably--.

Line 63, "are a pair" should be --is a pair--.

Column 6

Line 55, "to a support" should be --to support--.

Column 10

Line 2, "to a support" should be --to support--.

Signed and Sealed this
Thirteenth Day of March, 2012

David J. Kappos
*Director of the United States Patent and Trademark Office*